US007956306B2

(12) United States Patent
Ye et al.

(10) Patent No.: US 7,956,306 B2
(45) Date of Patent: Jun. 7, 2011

(54) HIGH-VOLTAGE SWITCH WITH A METAL CONTAINER FILLED WITH INSULATING GAS

(75) Inventors: Xiangyang Ye, Künten (CH); Martin Kriegel, Unterehrendingen (CH); Andreas Dahlquist, Zürich (CH); Fredrik Jonsson, Bellikon (CH)

(73) Assignee: ABB Research Ltd, Zurich (CH)

( * ) Notice: Subject to any disclaimer, the term of this patent is extended or adjusted under 35 U.S.C. 154(b) by 662 days.

(21) Appl. No.: 11/987,649

(22) Filed: Dec. 3, 2007

(65) Prior Publication Data

US 2008/0135522 A1 Jun. 12, 2008

(30) Foreign Application Priority Data

Dec. 6, 2006 (EP) ..... 06405507

(51) Int. Cl.
*H01H 33/02* (2006.01)

(52) U.S. Cl. ..... 218/76; 218/13; 218/78

(58) Field of Classification Search ..... 218/43, 218/45–47, 51–57, 59–64, 67–73, 76–80, 218/156, 157
See application file for complete search history.

(56) References Cited

U.S. PATENT DOCUMENTS

| | | | | |
|---|---|---|---|---|
| 5,850,065 | A | 12/1998 | Yaginuma et al. | |
| 6,646,850 | B1 * | 11/2003 | Bergmann et al. | 218/54 |
| 6,717,791 | B1 * | 4/2004 | Wiesinger | 218/157 |
| 7,402,771 | B2 * | 7/2008 | Ye et al. | 218/59 |

FOREIGN PATENT DOCUMENTS

| | | | |
|---|---|---|---|
| EP | 1 605 485 | A1 | 12/2005 |
| EP | 1 835 520 | A1 | 9/2007 |
| JP | 8-195148 | A | 7/1996 |

OTHER PUBLICATIONS

European Search Report for EP 06 40 5507 dated Mar. 1, 2007.

* cited by examiner

*Primary Examiner* — Renee Luebke
*Assistant Examiner* — Marina Fishman
(74) *Attorney, Agent, or Firm* — Buchanan Ingersoll & Rooney PC

(57) ABSTRACT

A high-voltage switch has a metal container filled with insulating gas, and a quenching chamber installed in the container. The quenching chamber contains a housing which is aligned along an axis, an arcing contact arrangement which is held in the housing, an exhaust volume which is bounded by the housing, and an outlet channel which is passed through the wall of the housing for exhaust gases. The outlet channel opens with a mouth section which is aligned predominantly axially into the container. The mouth section is bounded on the inside by a tubular section of the housing and on the outside by a tubular housing attachment which surrounds the housing section at a distance from it. An electrically shielded edge which is passed in an annular shape around the axis is arranged on one end face of the housing attachment on which edge a flow, which emerges from the outlet channel of the exhaust gases is detached from the housing attachment.

14 Claims, 1 Drawing Sheet

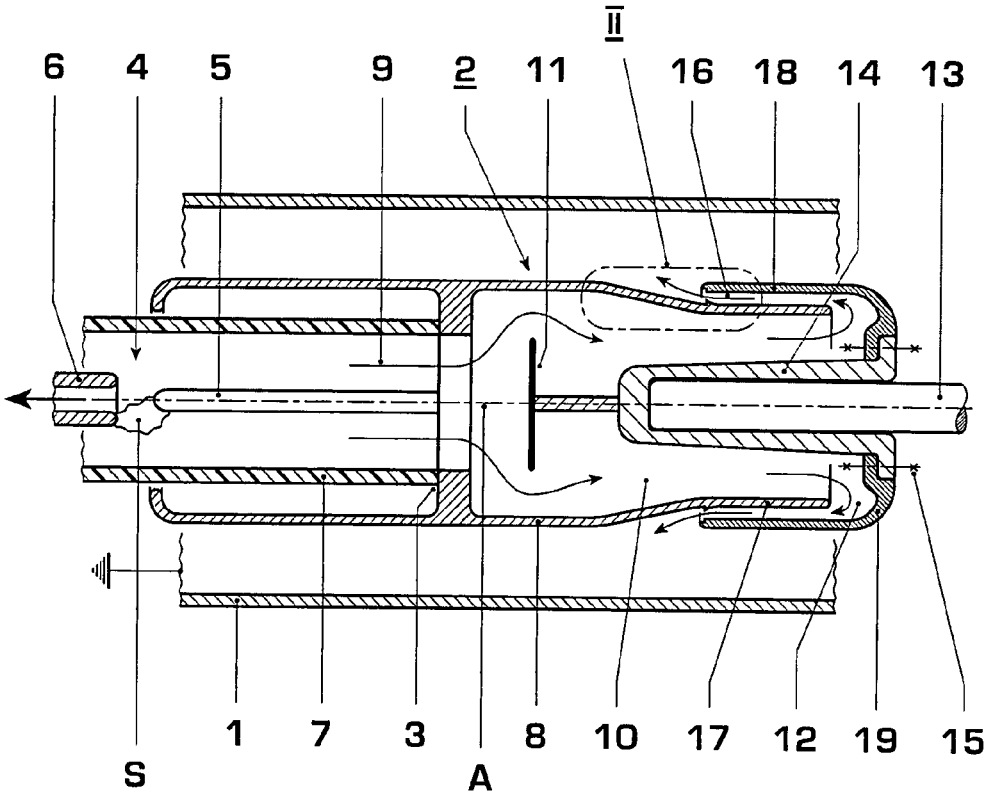
FIG. 1
FIG. 2
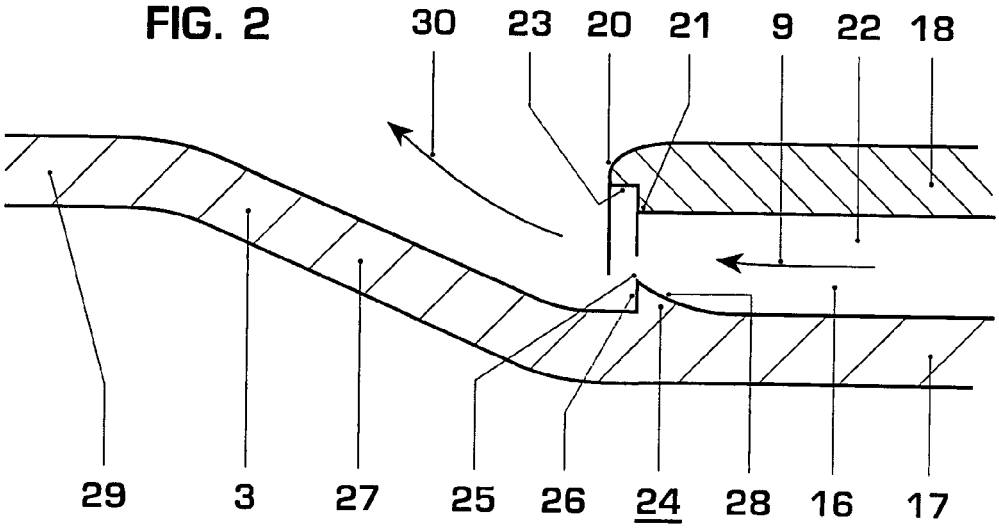

HIGH-VOLTAGE SWITCH WITH A METAL CONTAINER FILLED WITH INSULATING GAS

RELATED APPLICATION

This application claims priority under 35 U.S.C. §119 to European Patent Application No. 06405507.2 filed in the European Patent Office on 6 Dec. 2006, the entire contents of which are hereby incorporated by reference in their entireties.

TECHNICAL FIELD

A high-voltage switch is disclosed. This switch has a metal container filled with insulating gas, and a quenching chamber installed in the container. The quenching chamber contains a housing which is aligned along an axis, an arcing contact arrangement which is held in the housing, an exhaust volume which is bounded by the housing, and an outlet channel which is passed through the wall of the housing for exhaust gases. The outlet channel opens with a mouth section which is aligned predominantly in the direction of the axis into the container. During operation of this switch, the switching chamber is at a high-voltage potential and hot exhaust gases produced by the switching arc during disconnection of a short-circuit current pass through the outlet channel into the metal container, which is at ground potential. The hot exhaust gases are of low density and therefore, locally and temporarily, reduce the dielectric characteristics of the insulating gas in the metal container.

BACKGROUND INFORMATION

A high-voltage switch of the type mentioned initially is described in the prior European patent application file reference EP 06 40 5112.1, filed on Mar. 14, 2006. This switch contains a quenching chamber having an arcing contact arrangement held in a housing, and having an exhaust unit which is integrated in the housing and has an exhaust volume bounded by the housing and an outlet which is passed through the housing for exhaust gases. An exhaust module in the form of a pot is placed over the exhaust unit, arranged coaxially. The housing and the pot bound a mouth section of an exhaust channel with an electrically shielded, axially aligned outlet flow opening. The exhaust gases therefore in general only insignificantly adversely affect the quality of gas insulation between a metal container which holds the quenching chamber and is filled with insulating gas, and the housing, so that the switch can also be loaded with high-power switching arcs that last for a long time as is the consequence, for example, of reducing the high-voltage frequency from, for example, 50 to 16⅔ Hz.

SUMMARY

The disclosure is based on the object of providing a high-voltage switch of the type mentioned initially, that is distinguished by high operational reliability.

A high-voltage switch is disclosed having a metal container filled with insulating gas and having a quenching chamber installed in the container, containing a housing which is aligned along an axis, an arcing contact arrangement which is held in the housing, an exhaust volume which is bounded by the housing, and an outlet channel which is passed through the wall of the housing for exhaust gases in which the outlet channel opens with a mouth section which is aligned predominantly axially into the container, and in which the mouth section is bounded on the inside by a tubular first section of the housing and on the outside by a tubular housing attachment which surrounds the housing section at a distance from it. An electrically shielded first edge is arranged on one end face of the housing attachment, is passed in an annular shape around the axis and is used for detachment of a flow emergent from the outlet channel of the exhaust gases from the housing attachment.

BRIEF DESCRIPTION OF THE DRAWINGS

One exemplary embodiment of the disclosure will be explained in more detail in the following text with reference to the drawings, in which:

FIG. 1 shows a plan view of a section, along an axis, through a part of a gas-insulated high-voltage switch according to the disclosure, and FIG. 2 shows an enlargement of a part of the switch, marked by boundary in FIG. 1.

DETAILED DESCRIPTION

In the case of the switch according to the disclosure, an electrically shielded edge which is passed around an axis in an annular shape is arranged on one end face of a housing attachment which bounds a mouth section of an outlet on the outside. An exhaust gas flow which is carried in the mouth section is detached from the housing attachment on this edge, and can now enter a metal container as a gas jet which is bounded radially on the outside. The hot gas jet, which has a low density and therefore only comparatively weak dielectric characteristics is carried away from electrically highly loaded areas on the end face of the housing attachment because of the flow separation on the edge. This prevents hot exhaust gases from being carried because of the Coanda effect from the inner surface of the housing attachment over a convex-curved surface of the end face to the outer surface of the housing attachment, which likewise has convex curvature, and in the process flowing through dielectrically highly loaded areas. Dielectrically highly loaded areas such as these are predominantly located adjacent to the end face and a section, adjacent to the end face, of the outside of the housing attachment, that is to say in areas in which the radii of curvature of the field-loaded surfaces of the housing attachment are relatively small. The suppression of the Coanda effect allows the dielectric strength of the switch at the outlet point of the exhaust gases into the metal container, which is filled with insulating gas and is at earth potential, to be increased by up to 30% and accordingly allows the operational reliability of the switch to be considerably improved.

In general, the edge has a small radius of curvature in comparison to the radii of curvature of the field-loaded surfaces of the housing attachment. If the edge bounds an inner surface of the housing attachment in the flow direction of the exhaust gases, then the flow is detached in a defined manner at a dielectrically lightly loaded point which can easily be positioned. In order to achieve good dielectric characteristics, the edge is in this case arranged offset radially inwards with respect to a convex-curved surface, which acts as the electrical shield, of the end face and/or is arranged axially offset in the opposite direction to the flow direction with respect to a rim which bounds the end face in the flow direction. If a step which extends from the rim to the edge is provided in the end face, then the exhaust gases can be detached from the housing attachment, even when the flow rate is low, on entering the metal container, and the edge is at the same time particularly effectively electrically shielded.

In order to prevent the hot exhaust gases emerging from the mouth section into the metal container from being carried along a section of the housing which is adjacent to a housing section which bounds the mouth section on the inside, a flow ring which is passed around the axis and has an electrically shielded second edge is arranged on an outer surface of the housing section associated with the mouth section. This edge is offset radially outwards with respect to the outer surface. The flow ring advantageously has a profile in the form of a sawtooth with a steep flank arranged in the opposite direction to the flow direction of the exhaust gases. A flank such as this results in reliable separation of the flow on the second edge which forms the tip of the sawtooth and therefore together with the edge provided on the housing attachment, allows the formation of a dielectrically advantageous free jet with an annular cross section.

In general, a section of the housing which is adjacent to the abovementioned housing section or the flow ring widens conically. The free jet which emerges from the mouth section is reliably maintained if a flat flank, which is arranged in the flow direction of the exhaust gases, of the flow ring has a greater gradient than the conically widening housing section.

The isolation gaps predetermined by the geometric dimensions of the metal container can be maintained if a tubular housing section with a diameter matched to the housing attachment is adjacent to the conically widening housing section.

The same reference symbols refer to parts having the same effect in both figures. The high-voltage switch illustrated in FIG. 1 has a largely tubular metal container 1 which is filled with an insulating gas, for example, based on sulfurhexafluoride, nitrogen, oxygen or carbon dioxide or mixtures of these gases, such as air, at a pressure of up to several bar, and in which a quenching chamber 2 is arranged. The quenching chamber is held electrically insulated in the metal container 1 with the aid of a post insulator, which cannot be seen in the figure. The quenching chamber 2 contains a housing 3 which is designed to be largely symmetrical with respect to an axis A, and contains, in the housing interior, an quenching contact arrangement 4 with two arcing contacts 5, 6 which can move relative to one another. In general, the quenching chamber housing 3 also holds a rated-current contact arrangement, which is intended to carry the continuous current and is connected in parallel with the arcing contacts 5, 6, although this is not illustrated, for clarity reasons. The quenching chamber housing is formed by an insulating tube 7 and two metallic hollow bodies which are attached in a gas-tight manner to its ends, of which only the hollow body 8 which forms the right-hand end of the housing 3 is illustrated. The second hollow body, which is not illustrated, forms the left-hand end of the housing 1 and is mounted on the post insulator, which likewise cannot be seen.

The two hollow bodies are in general manufactured from cast metal, for example based on steel or aluminum, and are used to hold hot exhaust gases 9 which are formed in the contact arrangement 4 during a switching process and for carrying the switch current and shielding parts of the quenching chamber 2 which are subject to strong electrical fields during operation of the switch, that is to say when loaded with high voltages of up to 100 or more kV and when carrying short-circuit currents of 50 or more kA. The hollow body 8 bounds an exhaust volume 10 and holds a gas mixing apparatus 11, which is arranged in the exhaust volume. The exhaust gases 9 are carried out of the exhaust volume 10 outwards into the metal container 1 which is filled with insulating gas, via an outlet channel 12 which passes through the housing 3. The switch current is fed from the right through a current-carrying bolt 13 which is electrically conductively inserted into a sleeve 14 in the form of a cup. The base of the cup or of the sleeve 14 is fitted with the gas mixing apparatus 11. The rim of the cup is passed radially outwards and is fixed to a boundary with the aid of screw connections 15, which boundary bounds an axially aligned opening in the hollow body 8, through which the bolt 13 is passed to the outside.

As can be seen, the outlet channel 12 opens with an axially extended mouth section 16, in the form of a hollow cylinder, into the metal container 1. The mouth section 16 is bounded on the inside by a tubular section 17 of the housing 1, and on the outside by a tubular housing attachment 18 which surrounds the housing section 17, at a distance from it. The housing attachment 18 is part of a termination element 19 of the hollow body 8, which is in the form of a pot, is connected by means of the screw connection 15 to the sleeve 14 and holds said sleeve 14, and to which the element 19 is attached via radial webs or screws which are not illustrated.

As can be seen in FIG. 2, a separation edge 21 which is passed in an annular shape around the axis A (FIG. 1) is formed in one end face 20 of the housing attachment 18. This edge bounds the inner surface 22 of the housing attachment 18 on the left, that is to say in the flow direction of the exhaust gases 9, and is arranged offset radially inwards with respect to a convex-curved surface of the end face 20, which provides electrical shielding. As can be seen, the edge 21 is arranged offset to the right, that is to say in the opposite direction to the flow direction, with respect to a rim which bounds the end face on the left. The radial and the axial offset of the edge 21 are achieved by a step 23 which is formed in the end face and extends from its rim to the edge 21.

A flow ring 24 with a separation edge 25, which is passed around the axis in the form of a ring, is formed in the outer wall of the housing section 17. The edge 25 is arranged offset radially outwards with respect to the surrounding outer wall of the housing 3 or of the housing section 17. The flow ring 24 has a profile in the form of a sawtooth, with a steep flank 26 which is arranged in the opposite direction to the flow direction of the exhaust gases 9. A conically widening housing section 27 is adjacent to the flow ring 24 in the flow direction of the exhaust gases. A flat flank 28 arranged in the flow direction of the exhaust gases, of the flow ring 24 has a greater gradient than the conically widening housing section 27 and adjacent to which there is a tubular housing section 29 with a diameter matched to the housing attachment 18.

During disconnection of a short-circuit current, the arcing contact 6 is moved to the left by a drive acting in the direction of the arrow. A switching arc S which is fed from the current to be disconnected, is struck between the opening contacts 5, 6 of the arcing contact arrangement 4. This arc heats the surrounding insulating gas, and can be quenched at the zero crossing of the current. Hot gases formed by the switching arc S pass as exhaust gases 9 into the exhaust volume 10, where they are precooled on the gas mixing apparatus 11, are passed through the wall of the quenching chamber housing 3 in the outlet channel 12 and, after leaving the predominantly axially aligned mouth section 16, are ejected as an annular free jet 30 into the metal housing 3.

The exhaust gases 9 are carried from right to left in the axial direction in the mouth section 16, and flow along the inner surface 22 of the housing attachment 18 and the outer surface of the housing section 17. A boundary layer, which adheres to the inner surface 22, of the exhaust gases ends at the separation edge 21, so that the exhaust gases are therefore detached from the housing attachment 18 and can enter the metal container 1 as a jet in electrically lightly loaded areas. This avoids the hot exhaust gases, which have comparatively weak dielectric characteristics because of their low density, from entering electrically highly loaded areas, in particular such as those adjacent to a convex-curved surface of the end face 20 and a likewise convex-curved section adjacent to it, of the outer surface of the housing attachment 18. The convex shape of the above-mentioned surfaces is necessary in order to control the electrical field which is produced between the grounded metal container 1 and the quenching chamber 2, which is at high-voltage potential, that is to say in order to reduce strong local electrical fields on the end face 20, and to avoid strong local electrical fields adjacent to the sharp separation edge 21.

If there were no separation edge 21, the Coanda effect could result in the boundary layer, which adheres to the inner surface 22, extending to the convex-curved end face 20 and to the surface section adjacent to it, and could thus lead to the hot exhaust gases being carried into electrically comparatively highly loaded areas.

The detachment of the exhaust gases 9 emerging from the mouth section 16 from the housing attachment 18 is assisted by the radius of curvature of the separation edge 21 being designed to be considerably less than the radii of curvature of the surface of the end face 20. A small radius of curvature such as this can therefore, if required, lead locally to an undesirably high electrical field load. The separation edge 21 is arranged offset radially inwards with respect to the curved surface of the end face 20, which provides electrical shielding, forming the step 23, but, as can be seen, also axially offset in the opposite direction to the flow direction of the exhaust gases 9, with respect to the end face 20. This ensures not only that the exhaust gas flow 9 is reliably detached from the housing attachment 18 but, at the same time, that the separation edge 21 is particularly effectively shielded against the electrical field in the metal container.

The flow ring 24 which is formed in the outer wall of the housing section 17 prevents the hot exhaust gases 9 which emerge from the mouth section 16 into the metal container 1 from being carried along the housing section 27, since the exhaust gas flow can be detached from the outer wall of the housing section 17 at the separation edge 25. The two separation edges 21 and 25 can thus result in the formation of the free jet 30, which is carried in a dielectrically particularly advantageous manner out of the mouth section 16 without any further contact with the housing directly into the insulating gas, which is provided in the container 1, is cool and is therefore dielectrically of high quality. The steep flank 26 makes it easier to detach the exhaust gas flow 9 from the housing 3.

In order additionally to simplify the detachment of the exhaust gas flow from the conically widening housing section 27, the flatter flank 28 of the flow ring can have a greater gradient than the conically widening housing section 27.

Since the housing section 29 has a diameter which largely matches that of the housing attachment 18, the isolation gaps which are predetermined by the geometric dimensions of the metal container 1, can be maintained between the grounded container wall and the housing attachment 17, which is at high-voltage potential.

As illustrated in FIG. 2, the edge 21 is in general in the form of a circle, but, if required, may also be composed of partial edges which are arranged at a distance from one another in the circumferential direction, distributed uniformly around the axis. Such partial edges can be formed by a mouth section which is formed from a plurality of axially routed channel elements which are distributed uniformly in the circumferential direction. In general, the cross-sectional profile of the channel elements is banana-shaped, which is advantageous from the flow point of view, but may also have a different shape, for example a circular or elliptical shape, which is easy to manufacture.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Metal container
2 Switching chamber
3 Switching chamber housing
4 Arcing contact arrangement
5, 6 Arcing contacts
7 Insulating tube
8 Hollow body
9 Exhaust gases
10 Exhaust volume
11 Gas mixing apparatus
12 Outlet channel
13 Electrical conductor, bolt
14 Sleeve
15 Screw connections
16 Mouth section
17 Housing section
18 Housing attachment
19 Termination element
20 End face
21 Separation edge
22 Inner surface
23 Step
24 Flow ring
25 Separation edge
26, 28 Flanks
27, 29 Housing sections
30 Free jet
A Axis
S Switching arc

What is claimed is:

1. A high-voltage switch having a metal container filled with insulating gas and having a quenching chamber installed in the container, containing a housing which is aligned along an axis, an arcing contact arrangement which is held in the housing, an exhaust volume which is bounded by the housing, and an outlet channel which is passed through the wall of the housing for guiding a flow of exhaust gases in which the outlet channel opens with a mouth section which is aligned predominantly axially into the container, and in which the mouth section is bounded on the inside by a tubular first section of the housing and on the outside by a tubular housing attachment which surrounds the housing section at a distance from it, and which housing section comprises an end face with a convex-shaped surface for controlling an electrical field between the metal container and the quenching chamber, wherein an electrically shielded first edge is arranged on one end face of the housing attachment, wherein the first edge bounds an inner surface of the housing attachment in a flow direction of the exhaust gases, and wherein the radius of curvature of the first edge is considerably smaller than the radius of curvature of the convex-shaped surface of the end face such that the flow of exhaust gases is passed in an annular shape around the axis, and wherein the first edge is used for detachment of a flow emergent from the outlet channel of the exhaust gases from the housing attachment and prevents the exhaust gases from entering areas which are adjacent to the convex-shaped surface of the end face and an adjoining convex-shaped section of an outer surface of the housing attachment.

2. The switch as claimed in claim 1, wherein the edge is arranged offset radially inwards with respect to a convex-curved surface, which acts as the electrical shield of the end face.

3. The switch as claimed in claim 1, wherein the edge is arranged axially offset in the opposite direction to the flow direction with respect to a rim which bounds the end face in the flow direction.

4. The switch as claimed in claim 3, wherein a step which extends from the rim to the edge is provided in the end face.

5. The switch as claimed in claim 1, wherein a flow ring which is passed around the axis and has an electrically shielded second edge which is offset radially outwards with respect to the outer surface is arranged on an outer surface of the housing section.

6. The switch as claimed in claim 5, wherein the flow ring has a profile in the form of a sawtooth with a steep flank arranged in the opposite direction to the flow direction of the exhaust gases.

7. The switch as claimed in claim 5, wherein a conically widening second housing section is adjacent to the flow ring.

8. The switch as claimed in claim 7, wherein a flat flank, which is arranged in the flow direction of the exhaust gases of the flow ring has a greater gradient than the conically widening second housing section.

9. The switch as claimed in claim 7, wherein a tubular third housing section with a diameter matched to the housing attachment is adjacent to the conically widening second housing section.

10. The switch as claimed in claim 2, wherein the edge is arranged axially offset in the opposite direction to the flow direction with respect to a rim which bounds the end face in the flow direction.

11. The switch as claimed in claim 4, wherein a flow ring which is passed around the axis and has an electrically shielded second edge which is offset radially outwards with respect to the outer surface is arranged on an outer surface of the housing section.

12. The switch as claimed in claim 6, wherein a conically widening second housing section is adjacent to the flow ring.

13. The switch as claimed in claim 8, wherein a tubular third housing section with a diameter matched to the housing attachment is adjacent to the conically widening second housing section.

14. A quenching chamber installable in a gas-filled container of a high-voltage switch, the quenching chamber comprising:

a housing which is aligned along an axis;

an arcing contact arrangement which is held in the housing;

an exhaust volume which is bounded by the housing; and an outlet channel which is passed through the wall of the housing for exhaust gases in which the outlet channel opens with a mouth section which is aligned predominantly axially into the container, and in which the mouth section is bounded on the inside by a tubular first section of the housing and on the outside by a tubular housing attachment which is at a distance from and surrounds the housing section wherein an electrically shielded first edge is arranged on one end face of the housing attachment, wherein the first edge bounds an inner surface of the housing attachment in a flow direction of the exhaust gases, and wherein the radius of curvature of the first edge is considerably smaller than the radius of curvature of the convex-shaped surface of the end face such that the flow of exhaust gases is passed in an annular shape around the axis, and wherein the first edge is used for detachment of a flow emergent from the outlet channel of the exhaust gases from the housing attachment and prevents the exhaust gases from entering areas which are adjacent to the convex-shaped surface of the end face and an adjoining convex-shaped section of an outer surface of the housing attachment.

* * * * *